US006051033A

United States Patent [19]

McDevitt et al.

[11] Patent Number: 6,051,033

[45] Date of Patent: Apr. 18, 2000

[54] METHOD FOR ENZYMATIC TREATMENT OF WOOL

[75] Inventors: Jason Patrick McDevitt, Wake Forest, N.C.; Jacob Winkler, København S, Denmark

[73] Assignee: Novo Nordisk Brochem North America Inc., Franklin, N.C.

[21] Appl. No.: 09/161,824

[22] Filed: Sep. 28, 1998

Related U.S. Application Data

[63] Continuation-in-part of application No. 09/082,218, May 20, 1998, abandoned, and a continuation-in-part of application No. 09/159,182, Sep. 23, 1998.

[51] Int. Cl.[7] ..... D06M 16/00; C12N 9/10

[52] U.S. Cl. ..... 8/115.51; 8/401; 8/107; 8/111; 8/127.51; 8/127.6; 8/137; 8/128.3; 435/193; 435/194; 435/263; 435/264; 435/267

[58] Field of Search ..... 8/401, 107, 111, 8/127.5, 127.51, 127.6, 128.1, 137, 128.3, 115.51; 435/193, 194, 262, 263, 264, 267

[56] References Cited

U.S. PATENT DOCUMENTS

| | | | |
|---|---|---|---|
| 4,533,359 | 8/1985 | Kondo et al. | 8/128.1 |
| 5,458,810 | 10/1995 | Fredj et al. | 510/320 |
| 5,478,489 | 12/1995 | Fredj et al. | 510/299 |
| 5,512,060 | 4/1996 | Fornelli et al. | 8/115.52 |
| 5,529,928 | 6/1996 | Ciampi et al. | 435/263 |
| 5,697,983 | 12/1997 | Connell et al. | 8/128.3 |

FOREIGN PATENT DOCUMENTS

| | | |
|---|---|---|
| 0 134 267 | 3/1985 | European Pat. Off. . |
| 0 134 267 A1 | 3/1985 | European Pat. Off. . |
| 0 358 386 | 3/1990 | European Pat. Off. . |
| 3213574 | 9/1991 | Japan . |
| WO 96/19611 | 6/1996 | WIPO . |
| WO 98/27264 | 6/1998 | WIPO . |

OTHER PUBLICATIONS

Heine et al., Review of Progress in Coloration, vol. 25, pp. 57–63 (1995) No Month Given.

Saverio Fornelli, International Dyer, vol. 178, No. 10, pp. 29–31 (Oct. 1993).

Abstract of Japanese Patent JP 3213574 A Sep. 18, 1991.

Abstract of JP–A 51099196 Sep. 1, 1976.

English Translation of JP–A 3213574 Sep. 18, 1991.

*Primary Examiner*—Mark Kopec
*Assistant Examiner*—Brian P. Mruk
*Attorney, Agent, or Firm*—Steve T. Zelson; Valeta A. Gregg

[57] ABSTRACT

A method of treating wool, wool fibers or animal hair with a proteolytic enzyme and a transglutaminase. The described method results in improved shrink-resistance, handle, appearance, wettability, reduction of felting tendency, increased whiteness, reduction of pilling, improved softness, tensile strength retention, improved stretch, improved burst strength, and improved dyeing characteristics such as dye uptake and dye washfastness. Furthermore, relative to treatments with proteolytic enzymes alone (no transglutaminase), the described method results in reduced weight loss, reduced fiber damage, and improved strength.

20 Claims, No Drawings

METHOD FOR ENZYMATIC TREATMENT OF WOOL

CROSS-REFERENCE TO RELATED APPLICATIONS

This application is a continuation-in-part of application Ser. No. 09/082,218 filed on May 20, 1998 now abandoned and Application Ser. No. 09/159,182 filed Sep. 23, 1998 entitled "A Method For Enzymatic Treatment of Wool", the contents of which are fully incorporated herein by reference.

FIELD OF THE INVENTION

The present invention relates to a method of treating wool, wool fibers or animal hair with a transglutaminase and a proteolytic enzyme.

BACKGROUND OF THE INVENTION

Two major problems associated with wool are its tactile discomfort (itchiness) and tendency to shrink. Improvements in softness and handle of wool can be achieved by addition of various chemical agents such as silicone softeners or by addition of proteolytic enzymes. The cost of these improvements may be greater than the moderate benefits achieved. Changes in one property of wool can affect other properties, sometimes adversely. For example, protease treatments normally have adverse effects on strength and weight of wool material.

Methods to generate shrink-resistant wool are known. The most commonly used method is the IWS/CSIRO Chlorine Hercosett process, which comprises an acid chlorination of wool, followed by a polymer application. This process imparts a high degree of shrink-resistance to wool, but adversely affects the handle of wool, and generates environmentally damaging waste.

Methods to reduce shrinkage of wool which do not result in release of damaging substances to the environment have been suggested, including enzymatic processes as well as benign chemical processes such as low-temperature plasma treatments. Plasma treatment is a dry process which involves treating wool fiber material with electrical gas discharges (so-called plasma). At present, there are obstacles (cost, capacity, compatibility) to large-scale commercialization of a plasma treatment process.

Various enzymatic methods have been used to treat wool. JP-A 51099196 describes a process to treat wool fabrics with alkaline proteases. JP-A 3213574 describes a method to treat wool using transglutaminase (an enzyme naturally found in wool follicles from sheep) or a solution containing transglutaminase. WO 98/27264 describes a method for reducing the shrinkage of wool comprising contacting wool with an oxidase or a peroxidase solution under conditions suitable for reacting the enzyme with wool. U.S. Pat. No. 5,529,928 describes a process for obtaining a wool with a soft woolly handle and shrink-resistant properties by using an initial chemical oxidative step or an enzyme treatment (e.g. a peroxidase, a catalase, or a lipase) followed by a protease treatment, followed by heat treatment. EP 358386 A2 describes a method to treat wool which comprises a proteolytic treatment and one of or both an oxidative treatment (such as NaOCl) and a polymer treatment. EP 134267 describes a method for treating animal fibers with an oxidizing agent, followed by a proteolytic enzyme in a salt-containing composition.

The environmental and performance deficiencies associated with current industrial processes for wool treatment substantiate the need for novel processes that provide further improvements relating to shrink-resistance or softness. Enzymatic methods for treating wool, used alone or in conjunction with an oxidative chemical step, have had little commercial value, a fact that is attributable to their relatively high costs and their tendency to damage wool by causing weight and strength losses. There is a need for an improved enzymatic method to treat wool, wool fibers, or animal hair material which imparts improvements in softness, shrink-resistance, appearance, whiteness, dye uptake, and resistance to pilling, but causes less fiber damage than known enzymatic treatments.

SUMMARY OF THE INVENTION

The object of the present invention is to provide improved enzyme-based methods for treating wool, wool fibers or animal hair, in particular methods which provide advantages with regard to improved shrink-resistance, and/or improvements of softness and handle which are highly desired by the end-user, while minimizing fiber damage relative to existing degradative treatments of wool and other animal hair materials.

The invention relates to a method of treating wool, wool fibers or animal hair, comprising contacting the wool, wool fibers or animal hair in aqueous solution with a proteolytic enzyme, either preceding or, preferably, simultaneously with a transglutaminase.

The scalar structure of wool is responsible to a large degree for many of its properties, both good and bad, and is primarily responsible for wool's tendency to shrink. One way to achieve shrink-resistance is to remove the scales from the surface of wool. This process is not industrially practical for a number of reasons, in particular the extreme strength and weight losses that occur. An ideal commercial process for imparting shrink-resistance would necessarily alter the physical structure of the fiber surface without significantly weakening the fiber. Unfortunately, many methods that alter the scale structure (including conventional proteolytic enzyme treatment) do so via destructive means. At the molecular level, chemical bonds are ruptured, causing molecular weight degradation of the proteins. This molecular weight breakdown is responsible for the macroscopically observed reduction in strength and weight of the wool or animal hair textiles.

The present invention describes a method that uses two complementary enzymes to substantially modify the surface structure of the fiber while also minimizing degradation. Proteolytic enzymes cleave amide bonds, while transglutaminases form amide bonds, albeit different ones. In the context of the present invention, proteolytic enzymes are primarily responsible for breaking down the surface structure, while transglutaminases aid in that process, and also prevent the excessive molecular weight breakdown associated with proteolytic enzyme treatments. Consequently, relative to conventional proteolytic treatments, the treatments described in the present invention provide superior shrink-resistance, with reduced fiber damage. Other benefits are also achieved, either relative to untreated wool, wool treated with proteolytic enzymes, or wool treated with transglutaminases.

Depending on the particular characteristics of the wool subjected to the treatment according to the present invention, the benefits resulting from this treatment can be improved shrink-resistance, improved handle, improved appearance, improved wettability, reduction of felting tendency, increased whiteness, reduction of pilling, improved softness, tensile strength retention, improved stretch, improved burst strength, and improved dyeing characteristics such as dye uptake and dye washfastness. Furthermore, this combination reduces fiber damage, as manifested by reductions in fabric weight loss and burst strength, relative to protease treatments alone.

In a further embodiment, the wool, wool fibers or animal hair may have undergone an oxidative pre-treatment prior to any of the enzymatic treatments described above. Examples of oxidative pre-treatments include acidic chlorination, DCCA, sodium hypochlorite, caroat, and permanganate, as well as enzymatic treatments using oxidoreductases such as peroxidase or haloperoxidase.

DETAILED DESCRIPTION OF THE INVENTION

Before the methods of the invention are described, it is to be understood that this invention is not limited to the particular methods described. The terminology used herein is for the purpose of describing particular embodiments only, and is not intended to be limiting since the scope of the present invention will be limited only by the appended claims.

As used in this specification and the appended claims, the singular forms "a", "an", and "the" include plural references unless the context clearly dictates otherwise. Thus, for example, references to "proteolytic enzyme" or "proteolytic preparation" include mixtures of such proteolytic enzymes, reference to "the method" includes one or more methods, and/or steps of the type described herein and/or which will become apparent to those persons skilled in the art upon reading this disclosure and so forth.

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, the preferred methods and materials are now described. All publications mentioned herein are incorporated herein by reference for the purpose of disclosing and describing the material in connection with which the reference was cited.

Definitions

The term "shrinkage" refers to the felting shrinkage of fibers as defined in IWS TM 31, i.e., felting shrinkage is the irreversible shrinkage caused by progressive entanglement of the wool fibers induced by washing in an aqueous solution, and is defined as the reduction in length and/or width induced by washing. Shrinkage can be measured in accordance with IWS TM 31, or it can be measured using the following modification. Wool samples (24 cm×24 cm) are sewed around the edges and inscribed with a rectangle (18 cm×18 cm). Samples are treated, air-dried, then subjected to five cycles of machine washing and drying (warm wash, high heat of drying) in combination with external ballast such as towels and articles of clothing. The dimensions of the rectangle are measured after five cycles, and the shrinkage is defined as the change in dimensions of the rectangle, after accounting for initial relaxation shrinkage.

A reduction in shrinkage implies a reduction in felting, and thus all methods that provide improved shrink-resistance also provide "anti-felting" properties.

The term "handle" is a subjective term that refers to the sensation of touch or feel of a textile. The term "softness" is a subjective term referring to the feel of a textile, and is a component of handle.

The term "pilling" refers to the entangling of fibers into balls (pills), which are visible on the surface of a fabric. A pill is of sufficient density that it will cast a shadow. Resistance to pilling can be measured according to IWS Test Method 196, or can be inspected visually. Pilling is a major component of fabric appearance (along with other properties such as whiteness). Reduced pilling gives better appearance and improved resistance to pilling is implied herein wherever the term "superior appearance" is used.

The term "stretch" refers to the increase in length of a fibrous material when a fixed load is applied. In general, a higher value for stretch is preferred relative to a lower value. In the present context, the term "elongation" refers to the permanent increase in length (non-recoverable extension) of a fibrous material after application and removal of a fixed load. In general, a lower value for elongation is preferred relative to a higher value. Stretch and elongation have been measured in accordance with the following modification of IWS TM 179. Fabric strips (100 mm×55 mm rectangles, with the longer dimension in the weft direction) were placed in the jaws of a suitable tensile strength machine such as an Instron® 5564. The distance between the jaws was set at 60 mm, and the load was increased to 10N at a rate of extension of 100 mm/min. Once the desired load was reached, the direction of movement was immediately reversed, and the rate of contraction was equal to the rate of extension. Five cycles were performed. The extension after the first cycle was defined as the fabric "stretch", and the "elongation" was defined as the stretch after the fifth cycle relative to the stretch after the first cycle, i.e., $E=S_5/S_1$.

The term "whiteness" is intended to mean a optical determination of the extent of color on wool. Whiteness can be measured in Stensby units (W=L+3a−3b) on a suitable spectrophotometer such as the Macbeth Color-Eye® 7000.

The term "burst strength" refers to the pressure applied to a circular specimen in distending it to rupture. Burst strength can be measured (using a suitable apparatus such as the Mullen® tester from B. F. Perkins) in accordance with IWS TM 29, and can be performed on either wet or dry fabric.

The term "dyeing characteristics" refers to properties associated with dyeing of wool or animal hair material, including dye uptake and dye color fastness to wet alkaline contact (as defined in IWS TM 174). Dye uptake is a measure of the capacity of wool or animal hair material immersed in a dye solution to absorb available dyestuff. This property can be measured by the following test. In a suitable reaction vessel, wool or animal hair material is added to a buffered solution of acid black 172 (300 ml of 0.05 M NaOAc buffer, pH 4.5, plus 7.5 mL of a 1.0% w/w solution of acid black 172 in water). The vessel is incubated in a shaking water bath at 50° C. for 15 minutes with mild agitation. After removal of the material from solution, it is allowed to air-dry, then measured in a suitable spectrophotometer to determine CIELAB values. Dye uptake is determined by the L* reading, and changes in dye uptake are found by determining dL* relative to untreated material.

By the term "wool," "wool fiber," "animal hair," and the like, is meant any commercially useful animal hair product, for example, wool from sheep, camel, rabbit, goat, llama, and known as merino wool, shetland wool, cashmere wool, alpaca wool, mohair, etc.

The method of the invention can be used with wool or animal hair material in the form of top, fiber, yarn, or woven or knitted fabric. The enzymatic treatment can also be carried out on loose flock or on garments made from wool or animal hair material. The treatment can be performed at many different stages of processing, including either before or after dyeing. A range of different chemical additives can be added along with the enzymes, including wetting agents and softeners.

It should be emphasized that wool and other animal hair materials are products of biological origin. The material may vary greatly, e.g., in chemical composition and morphological structure depending on the living conditions and health of the animal. Accordingly, the effect(s) obtained by subjecting wool or other animal hair products to the method of the present invention may vary in accordance with the properties of the starting material.

The method of the invention

It is contemplated that enzymatic treatments can take place either as stand-alone steps or in combination with other treatments such as scouring or dyeing of wool or animal hair material. Wool or animal hair material is subjected to treatment with a transglutaminase either subsequent to or, preferably, simultaneously with a proteolytic enzyme treatment. Further, chemical additives such as surfactants and softeners can be included in enzyme treatment steps, or in separate steps. Such treatments can produce wool textiles having a novel combination of physical properties, such as improved handle, shrink-resistance, and appearance while reducing strength losses and fiber damage commonly observed in degradative treatments of wool.

Treatment conditions. The enzymatic treatment steps are preferably carried out for a duration of at least 1 minute and less than 150 minutes; preferably at a temperature from about 15° C. to about 90° C., more preferably from about 20° C. to about 70° C., in particular from about 30° C. to about 65° C. Alternatively, the wool can be soaked in or padded with an aqueous treatment solution and then subjected to steaming at a conventional temperature and pressure. It is contemplated that the reaction rate of the enzyme treatment step can be increased by increasing the temperature of the enzyme bath during the treatment, i.e., the total treatment time can be reduced.

The enzyme treatment can be carried out in an acidic, neutral or alkaline medium, depending on the particular enzyme in question. The medium may include a buffer. It may be advantageous to carry out the enzyme treatment step in the presence of one or more conventional anionic, nonionic or cationic surfactants. An example of a useful nonionic surfactant is Dobanol (from Henkel AG).

Proteolytic enzyme

A useful proteolytic enzyme for the method of the present invention is any enzyme having proteolytic activity at the actual process conditions, including a combination of two or more such enzymes. Thus, the enzyme may be a proteolytic enzyme of plant origin, e.g., papain, bromelain, ficin, or of animal origin, e.g. trypsin and chymotrypsin, or of microbial origin, i.e., bacterial or fungal origin or from yeasts. It is to be understood that any mixture of various proteolytic enzyme may be applicable in the process of the invention.

Also, any proteolytic enzyme variant can be used in the process of the present invention, wherein the term "variant" means an enzyme produced by an organism expressing a gene encoding a proteolytic enzyme, and wherein said gene has been obtained by mutation of a naturally occurring proteolytic enzyme gene, the mutation being of either random or site-directed nature, including the generation of the mutated gene through gene shuffling.

In a preferred embodiment of the invention, the proteolytic enzyme is a serine-protease, a metallo-protease, or an aspartate-protease. A serine protease is an enzyme that catalyzes the hydrolysis of peptide bonds, and contain an essential serine residue at the active site (White, Handler and Smith, 1973 "Principles of Biochemistry," Fifth Edition, McGraw-Hill Book Company, NY, pp. 271–272). They are inhibited by diisopropyl-fluorophosphate, but in contrast to metalloproteases, are resistant to ethylene diamino tetraacetic acid (EDTA) (although they are stabilized at high temperatures by calcium ions). Serine proteases hydrolyze simple terminal esters and are similar in activity to eukaryotic chymotrypsin, also a serine protease. A more narrow term, alkaline protease, covering a sub-group, reflects the high pH optimum of some of the serine proteases, from pH 9.0 to 11.0. The serine proteases usually exhibit maximum proteolytic activity in the alkaline pH range, whereas the metallo-proteases and the aspartate-proteases usually exhibit maximum proteolytic activity in the neutral and the acidic pH range, respectively.

A sub-group of the serine proteases is commonly designated the subtilases (Siezen et al., *Protein Engng.* 4 (1991) 719–737). They are defined by homology analysis of more than 40 amino acid sequences of serine proteases previously referred to as subtilisin-like proteases. A subtilisin was previously defined as a serine protease produced by Gram-positive bacteria or fungi, and according to Siezen et al., now is a subgroup of the subtilases. The amino acid sequences of a number of subtilases have been determined, including at least six subtilases from Bacillus strains, namely, subtilisin 168, subtilisin BPN', subtilisin Carlsberg, subtilisin DY, subtilisin amylosacchariticus, and mesentericopeptidase, one subtilisin from an actinomycetales, thermitase from *Thermoactinomyces vulgaris*, and one fungal subtilisin, proteinase K from *Tritirachium album*. The long time recognized group of serine proteases, the subtilisins, have according to this more recent grouping been divided into two sub-groups. One subgroup, I-S1, comprises the "classical" subtilisins, such as subtilisin 168, subtilisin BPN', subtilisin Carlsberg (ALCALASE®, Novo Nordisk A/S), and subtilisin DY. The other subgroup, I-S2, is described as highly alkaline subtilisins and comprise enzymes such as subtilisin PB92 (MAXACAL®, Genencor International, Inc.), subtilisin 309 (SAVINASE®, Novo Nordisk A/S), subtilisin 147 (ESPERASE®, Novo Nordisk A/S), and alkaline elastase YaB.

These subtilisins of group I-S2 and variants thereof constitute a preferred class of proteases which are useful in the method of the invention. An example of a useful subtilisin variant is a variant of subtilisin 309 (SAVINASE®) wherein, in position 195, glycine is substituted by phenylalanine (G195F or $^{195}$Gly to $^{195}$Phe).

Conveniently, conventional fermented commercial proteases are useful. Examples of such commercial proteases are Alcalase® (produced by submerged fermentation of a strain of *Bacillus licheniformis*), Esperase® (produced by submerged fermentation of an alkalophilic species of Bacillus), Rennilase® (produced by submerged fermentation of a non-pathogenic strain of *Mucor miehei*), Savinase® (produced by submerged fermentation of a genetically modified strain of Bacillus), e.g., the variants disclosed in the International Patent Application published as WO 92/19729, and Durazym® (a protein-engineered variant of Savinase®). All the mentioned commercial proteases are produced and sold by Novo Nordisk A/S, DK-2880 Bagsvaerd, Denmark. Other preferred serine proteases are proteases from Nocardiopsis, Aspergillus, Rhizopus, *Bacillus alcalophilus, B. cereus, N. natto, B. vulgatus, B. mycoide*, and subtilins from Bacillus, especially proteases from the species Nocardiopsis sp. and *Nocardiopsis dassonvillei* such as those disclosed in the International Patent Application published as WO 88/03947, especially proteases from the species Nocardiopsis sp., NRRL 18262, and *Nocardiopsis dassonvillei*, NRRL 18133. Yet other preferred proteases are the serine proteases from mutants of Bacillus subtilins disclosed in the International Patent Application Nos. PCT/DK89/00002 and PCT/DK97/00500, and in the International Patent Application published as WO 91/00345, and the proteases disclosed in EP 415 296 A2.

Another preferred class of proteases are the metalloproteases of microbial origin. Conveniently, conventional fermented commercial proteases are useful. An example of such a commercial protease is Neutrase® (Zn) (produced by submerged fermentation of a strain of *Bacillus subtilis*), which is produced and sold by Novo Nordisk A/S, DK-2880 Bagsvaerd, Denmark.

Other useful commercial protease enzyme preparation are Bactosol™ WO and Bactosol™ SI, available from Sandoz AG, Basle, Switzerland; Toyozyme™, available from Toyo Boseki Co. Ltd., Japan; and Proteinase K™ (produced by submerged fermentation of a strain of Bacillus sp. KSM-K16), available from Kao Corporation Ltd., Japan. The amount of proteolytic enzyme used is preferably in the range 0.001 g to 20 g, preferably in the range 0.01 g to 10 g, more preferably in the range 0.05 g to 5 g per kg wool, fiber, or hair.

Transglutaminase

The "transglutaminase" to be used according to the invention can be any transglutaminase, which includes both calcium-dependent and calcium-independent transglutaminases or mixtures of two or more transglutaminases. Transglutaminases are protein-glutamine γ-glutamyltransferases, and have been classified as enzymes having the number EC 2.3.2.13 according to Enzyme Nomenclature, Academic Press, Inc., 1992. Transglutaminases are enzymes capable of catalyzing an acyl transfer reaction, in which a γ-carboxamide group of a peptide-bound glutamine residue is the acyl donor. Primary amino groups in a variety of compounds may function as acyl acceptors with the subsequent formation of monosubstituted gamma-amides of peptide-bound glutamic acid. When the ϵ-amino group of a lysine residue in a peptide-chain serves as the acyl acceptor, the transglutaminases form intramolecular or intermolecular ϵ-(γ-glutamyl)lysine cross-links.

A wide array of transglutaminases has been identified and isolated from a number of animals and a few plant species. The most widely used animal-derived transglutaminase, Factor XIIIa, is a multi-subunit enzyme.

According to the invention, transglutaminases may be of mammalian origin, such as of human or bovine origin, of marine origin, such as derived from sea squirt (*Halocynthia roretzi*), or of microbial origin, such as of bacterial, yeast of filamentous fungus origin, or variants thereof.

In an embodiment of the invention, the transglutaminase is Factor XIIIa of human origin. In another embodiment, the transglutaminase is a microbial transglutaminase derived from *Streptomyces lydicus* (former *Streptomyces libani*), or variants thereof. Other suitable microbial transglutaminases have been described, including a transglutaminase from *Physarum polycephalum* (Klein et al., Journal of Bacteriology, Vol. 174, pages 2599–2605), as well as transglutaminases from Streptoverticillium, in particular from *Streptoverticillium mobaraense, Streptoverticillium cinnamoneum*, and *Streptoverticillium griseocarneum* (Motoki et al., U.S. Pat. No. 5,156,956), and from *Streptomyces lavendulae* (Andou et al., U.S. Pat. No. 5,252,469). The transglutaminases described in EP 481 504-A1 (Amano Pharmaceutical Co. LTD.) and WO 96/06931 (Novo Nordisk A/S), which are hereby incorporated by references, may also be used. In addition, transglutaminases derived from the class of fungi-like organisms Oomycetes, preferably from the genus Phytophthora, may be used. Other relevant Oomycetes transglutaminases are described in PCT/DK96/00031 (Novo Nordisk A/S), which are hereby incorporated by reference. Preferred transglutaminases are *Phytophthora cactorum* and *Streptoverticillium mobaraense* (available from Ajinomoto).

The amount of transglutaminase used is in the range 0.001 g to 10 g, preferably in the range 0.01 g to 5 g, more preferably in the range 0.02 g to 2 g per kg wool, fiber, or hair.

In another embodiment, the transglutaminase is added together with a polyamino-containing compound $R_1NHR_2NHR_3$, wherein $R_1$, $R_2$, and $R_3$ can be independently hydrogen, hydrocarbyl, or substituted hydrocarbyl, and any combination of $R_1$, $R_2$, and $R_3$ may or may not join together to form one or multiple rings, where the term "hydrocarbyl" means a linear, branched, or cyclic group which contains only carbon and hydrogen atoms; the term "heteroatom" refers to atoms other than carbon and hydrogen; and the term "substituted hydrocarbyl" refers to a hydrocarbyl substituted with one or more heteroatoms. Examples of polyamino-containing compounds are 1,12-diaminododecane and polyethylenimine.

Softeners

It may be desirable to treat the wool or animal hair material with a softening agent, either simultaneously with or after enzymatic treatments. The softeners conventionally used on wool are usually cationic softeners, either organic cationic softeners or silicone-based products, but anionic or non-ionic softeners are also useful. Examples of useful softeners are polyethylene softeners and silicone softeners, i.e., dimethyl polysiloxanes (silicone oils), H-polysiloxanes, silicone elastomers, aminofunctional dimethyl polysiloxanes, aminofunctional silicone elastomers, and epoxyfunctional dimethyl polysiloxanes, and organic cationic softeners, e.g., alkyl quarternary ammonium derivatives.

The invention is further illustrated in the following non-limiting examples.

EXAMPLES

Example 1

Treatment with Transglutaminase and Protease

Swatches (24 cm×24 cm, with 18×18 $cm^2$ rectangle inscribed on each, approximately 9 g each) of jersey knit wool (TestFabrics TF532) were sewn around the edges. Samples were placed in separate Launder-O-meter beakers containing 250 mL of a 0.04 M Tris buffer, pH 8.25 at 25° C., containing 5 mM calcium chloride. A solution of ESPERASE® 8.0 L (200 μl) was added to the vessels, followed immediately by a solution of *Phytophthora cactorm* transglutaminase (containing 4 mg transglutaminase). The vessels were placed in the Launder-O-meter and allowed to react for 40 minutes at 44° C., followed by a ten minute heating gradient up to 80° C., then held at that temperature for ten minutes to inactivate the enzymes. The sample was removed from the solution, rinsed, dried, and measured, then subjected to five cycles of machine washing and drying, before being subjected to further property testing.

Example 2

Treatment with Haloperoxidase, Savinase, and Transglutaminase

Two swatches (24 cm×24 cm, with 18×18 $cm^2$ rectangle inscribed on each, approximately 9 g each) of jersey knit wool (TestFabrics TF532) were sewn around the edges. The swatches were immersed in 500 ml of a 25 mM sodium acetate buffer containing 10 mM NaCl and 10 mM hydrogen peroxide, pH 5, and treated with *Curvularia verruculosa* haloperoxidase (3.3 mg pure enzyme) for 50 minutes at 40° C. in an incubating shaker bath. After 30 minutes, sufficient hydrogen peroxide was added to boost the depleted peroxide concentration by 5 mM. Samples were rinsed and allowed to air-dry, then placed in separate Launder-O-meter beakers containing 250 ml of a 0.04 M Tris buffer, pH 8.25 at 25° C., containing 5 mM calcium chloride. A solution of SAVINASE® 16.0 L (200 μl) was added to the vessels, followed immediately by a solution of *Phytophthora cactorum* transglutaminase (containing 6 mg transglutaminase). The vessels were placed in the Launder-O-meter and allowed to react for 40 minutes at 44° C., followed by a ten minute heating gradient up to 80° C., then held at that temperature for ten minutes to inactivate the enzyme. The sample was removed from the solution, rinsed, dried, and measured, then subjected to five cycles of machine washing and drying, before being subjected to further property testing.

Example 3

Treatment with Haloperoxidase, Esperase, and Transglutaminase

Two swatches (24 cm×24 cm, with 18×18 $cm^2$ rectangle inscribed on each, approximately 9 g each) of jersey knit wool (TestFabrics TF532) were sewn around the edges. The swatches were immersed in 500 ml of a 25 mM sodium acetate buffer containing 10 mM NaCl and 10 mM hydrogen peroxide, pH 5, and treated with *Curvularia verruculosa* haloperoxidase (3.3 mg pure enzyme) for 50 minutes at 40° C. in an incubating shaker bath. After 30 minutes, sufficient hydrogen peroxide was added to boost the depleted peroxide concentration by 5 mM. Samples were rinsed and allowed to air-dry, then placed in separate Launder-O-meter beakers containing 250 ml of a 0.04 M Tris buffer, pH 8.25 at 25° C., containing 5 mM calcium chloride. A solution of ESPERASE® 8.0 L (200 μL) was added to the vessels, followed immediately by a solution of *Phytophthora cactorum* transglutaminase (containing 6 mg transglutaminase). The vessels were placed in the Launder-O-meter and allowed to react for 40 minutes at 44° C., followed by a ten minute heating gradient up to 80° C., then held at that temperature for ten minutes to inactivate the enzyme. The sample was removed from the solution, rinsed, dried, and measured, then subjected to five cycles of machine washing and drying, before being subjected to further property testing.

Example 4

Treatment with Haloperoxidase, Esperase, and Transglutaminase

Two swatches (24 cm×24 cm, with 18×18 $cm^2$ rectangle inscribed on each, approximately 9 g each) of jersey knit wool (TestFabrics TF532) were sewn around the edges. The swatches were immersed in 500 ml of a 25 mM sodium acetate buffer containing 10 mM NaCl and 10 mM hydrogen peroxide, pH 5, and treated with *Curvularia verruculosa* haloperoxidase (3.3 mg pure enzyme) for 50 minutes at 40° C. in an incubating shaker bath. After 30 minutes, sufficient hydrogen peroxide was added to boost the depleted peroxide concentration by 5 mM. Samples were rinsed and allowed to air-dry, then placed in separate Launder-O-meter beakers containing 250 ml of a 0.04 M Tris buffer, pH 8.25 at 25° C., containing 5 mM calcium chloride. A solution of ESPERASE® 8.0 L (200 μL) was added to the vessels, followed immediately by a solution of *Streptoverticillium mobaraense* transglutaminase (Ajinomoto)(containing 0.9 mg transglutaminase). The vessels were placed in the Launder-O-meter and allowed to react for 40 minutes at 44° C., followed by a ten minute heating gradient up to 80° C., then held at that temperature for ten minutes to inactivate the enzyme. The sample was removed from the solution, rinsed, dried, and measured, then subjected to five cycles of machine washing and drying, before being subjected to further property testing.

The sample had a very soft handle, a pleasing appearance as a result of increased whitening and reduced pilling, and an area shrinkage of only 12% after five wash-dry cycles, corresponding to a shrink-resistance of 64%.

Example 5

Treatment with Sodium hypochlorite, Savinase, and Transglutaminase.

A swatch (24 cm×24 cm, with inscribed 18×18 $cm^2$ rectangle, approximately 9 g) of jersey knit wool (TestFabrics TF532) was sewn around the edges. The swatch was immersed in 250 ml of a 25 mM sodium acetate buffer containing 10 mM NaCl, pH 5, and treated with 1.5 ml of a commercial solution of sodium hypochlorite (Austin's® bleach, 5.25 % sodium hypochlorite). The reaction was allowed to proceed for 50 minutes at 40° C. in a Launder-O-meter, at which point the fabric was removed from solution and rinsed with water, then placed in a Launder-O-meter beaker containing 250 ml of a 0.04 M Tris buffer, 5 mM calcium chloride, pH 8.35 at 25° C. A solution of SAVINASE® 16.OL (200 μL) was added to the vessels, followed immediately by a solution of *Phytophthora cactorum* transglutaminase (containing 6 mg transglutaminase). The vessels were placed in the Launder-O-meter and allowed to react for 40 minutes at 44° C., followed by a ten minute heating gradient up to 80° C., then held at that temperature for ten minutes to inactivate the enzyme. The sample was removed from the solution, rinsed, dried, and measured, then subjected to five cycles of machine washing and drying, before being subjected to further property testing.

Example 6

Weight Loss, Burst Strength, and Shrinkage of Wool Treated with Protease and Glutaminase Wool swatches were subjected to a combined protease and transglutaminase treatment. The samples were thoroughly rinsed, wrung dry, then subjected to six machine wash/dry cycles, (two with cold wash and hot drying, four with warm wash and high heat drying), equilibrated in a constant temperature and humidity room, then tested.

Experimental Conditions: Material: Wool swatches (jersey knit wool—TestFabrics TF532), 24 cm×24 cm, with 18×18 $cm^2$ rectangle inscribed on each, approximately 9 g each, sewn around the edges.

Treatment Conditions: Wool swatches were incubated individually in Launder-O-meter vessels in 250 mL buffer (40 mM Tris, pH 8.25 at 25° C.) containing the specified amounts of Esperase 8.0 L and *Phytophthora cactorum* transglutaminase solution approximately 4% protein by weight in solution); for 40 minutes at 44° C., ramped up to 80° C. over ten minutes, then held at 80° C. for ten minutes.

| Sample | Esperase (mL) | TG (μL) | Weight Loss (%) | Strength (lb/sq. in.) | Shrinkage (%) |
|---|---|---|---|---|---|
| 1 | 0 | 0 | −0.61 | 55.0 | 30.2 |
| 2 | 0 | 50 | −0.41 | 53.3 | 28.8 |
| 3 | 0 | 200 | −0.45 | 53.0 | 28.0 |
| 4 | 0 | 1000 | −0.52 | 53.0 | 29.2 |
| 5 | 1 | 0 | −2.63 | 52.7 | 22.3 |
| 6 | 1 | 50 | −2.93 | 50.0 | 24.2 |
| 7 | 1 | 100 | −2.52 | 53.7 | 17.0 |
| 8 | 1 | 200 | −2.87 | 48.7 | 18.8 |
| 9 | 1 | 400 | −2.78 | 53.3 | 20.6 |

Note: Weight loss was measured after six wash-dry cycles. Shrinkage is measured after six machine wash/dry cycles. "Strength" is a measure of the dry burst strength of the wool fabric, with several tests per swatch.

As is apparent from the above data table, a combination treatment using the optimum concentration of transglutaminase yields wool with reduced fiber damage (as manifested in decreased weight loss and increased burst strength) and increased shrink-resistance relative to wool treated exclusively with protease. Furthermore, the data indicate that treatment with transglutaminase alone does not provide significant benefits.

It should be pointed out that transglutaminase is a cross-linking enzyme. It is critical to optimize the extent of cross-linking for every different set of reaction conditions, as too much cross-linking results in brittle, weak fibers. Thus, the optimized level of transglutaminase identified in this example is for a given transglutaminase, for use with the specified quantity of Esperase®, at the specified temperature and time, with the specified wool. It is clear that changes in reaction conditions require changes in the optimal amount of transglutaminase (and obviously not all transglutaminases behave the same). Thus, we are unable to identify a universal preferred concentration ratio for all combination of proteases and transglutaminases under all possible reaction conditions.

Example 7

Weight Loss, Burst Strength, Whiteness and Shrinkage of Wool Treated with Protease and Transglutaminase Following a Mild Oxidative Treatment Wool swatches were subjected to a mild oxidative chlorination step using an acidified solution of sodium hypochlorite, then rinsed, wrung dry, and subjected to a combined protease and transglutaminase treatment. The samples were thoroughly rinsed, wrung dry, subjected to five machine wash/dry cycles (warm wash, high heat drying), equilibrated in a constant temperature and humidity room, then tested.

Experimental Conditions: Material: Wool swatches jersey knit wool—TestFabrics TF532), 24 cm×24 cm, with 18×18 $cm^2$ rectangle inscribed on each, approximately 9 g each, sewn around the edges.

Pre-Treatment Conditions: Wool swatches were incubated in pairs in Launder-O-Meter vessels with 500 mL buffer (25 mM sodium acetate, pH 5.0 at 25° C.) containing 1 mL of commercial household bleach solution (5.25% sodium hypochlorite by weight) for 45 minutes at 40° C.

Treatment Conditions: Wool swatches were incubated in pairs in Launder-O-Meter vessels with 500 mL buffer (40 mM Tris, pH 8.30 at 25° C.) containing 0.4 mL Savinase 16.0 L and the indicated amount of *Phytophthora cactorum* transglutaminase solution (approximately 4 % protein by weight in solution); for 40 minutes at 54° C., ramped up to 80° C. over ten minutes, then held at 80° C. for ten minutes.

| Sample | Savinase (mL) | Temp. (° C.) | TG (μL) | Weight Loss (%) | Strength (lb/sq. in.) | Shrinkage (%) | Whiteness (W) |
|---|---|---|---|---|---|---|---|
| 1 | 0 | 44 | 0 | −0.18 | 36.7 | 30.0 | −2.5 |
| 2 | 0.2 | 54 | 0 | 5.45 | 33.5 | 23.0 | 3.5 |
| 3 | 0.2 | 54 | 100 | 4.88 | 33.6 | 17.0 | 4.7 |
| 4 | 0.2 | 54 | 200 | 4.95 | 33.8 | 15.8 | 6.3 |

Note: All values represent the average of two runs. Reactant concentrations are per wool swatch. Weight loss was measured after six wash-dry cycles. Shrinkage was measured after five machine wash/dry cycles. "Strength" is a measure of the wet burst strength of the wool fabric, with several tests per swatch. Whiteness (in Stensby units) was measured after 5 wash-dry cycles.

After a mild oxidative chlorination pre-treatment, treatment of wool with a selected tion of protease and transglutaminase gives superior shrink-resistance and ss relative to untreated or protease-treated wool, while conserving weight and losses relative to treatments with protease alone.

We claim:

1. A method of treating wool, wool fibers or animal hair, comprising contacting the wool, fibers or hair in aqueous solution comprising (i) a proteolytic enzyme, and (ii) a transglutaminase, in an amount effective to increase shrink-resistance and decrease fiber damage relative to untreated wool, fibers, or hair.

2. The method of claim 1, wherein the wool, wool fiber, or animal hair is treated simultaneously with a proteolytic enzyme and a transglutaminase.

3. The method of claim 1, wherein the wool, wool fiber, or animal hair is treated with a transglutaminase following treatment with a proteolytic enzyme.

4. The method of claim 1, wherein the proteolytic enzyme is of plant, animal, bacterial, or fungal origin.

5. The method of claim 4, wherein the proteolytic enzyme is selected from the group consisting of papain, bromelain, ficin, and trypsin.

6. The method of claim 4, wherein the proteolytic enzyme is a serine protease.

7. The method of claim 6, wherein the serine protease is a subtilisin derived from Bacillus or Tritirachium.

8. The method of claim 1, wherein the amount of protease used per kg wool, fiber, or hair is in the range 0.001 g to 10 g.

9. The method of claim 1, wherein the transglutaminase is derived from Streptoverticillium.

10. The method of claim 1, wherein the transglutaminase is derived from Phytophthora.

11. The method of claim 1, wherein the transglutaminase is human Factor XIIIa.

12. The method of claim 1, wherein the transglutaminase is added along with a polyamino-containing compound $R_1NHR_2NHR_3$, wherein $R_1$, $R_2$, and $R_3$ are independently one of hydrogen, hydrocarbyl, or substituted hydrocarbyl, and optionally, two or more of $R_1$, $R_2$, and $R_3$ form one or multiple rings.

13. The method of claim 12, wherein the polyamino-containing compound is polyethylenimine.

14. The method of claim 1, wherein the amount of transglutaminase used per kg wool, fiber, or hair is in the range 0.001 g to 10 g.

15. The method of claim 1, wherein the aqueous solution additionally comprises a softening agent.

16. The method of claim 1, wherein the wool, wool fibers or animal hair are treated with a softening agent after the protease and transglutaminase treatment.

17. The method of claim 1, wherein the wool, wool fibers, or animal hair are subjected to an oxidative treatment prior to said treatment with protease and transglutaminase.

18. The method of claim 17, wherein said oxidative treatment is an oxidative chlorination.

19. The method of claim 17, wherein said oxidative treatment comprises enzymatic treatment with an oxidoreductase.

20. The method of claim 19, wherein said oxidoreductase is a haloperoxidase.

* * * * *